United States Patent [19]

Miller

[11] Patent Number: 4,730,807

[45] Date of Patent: Mar. 15, 1988

[54] SURF POOL GATE VALVE

[75] Inventor: Robert P. Miller, Wooster, Ohio

[73] Assignee: WaveTek International, Inc., Mansfield, Ohio

[21] Appl. No.: 775,936

[22] Filed: Sep. 10, 1985

Related U.S. Application Data

[63] Continuation of Ser. No. 556,303, Nov. 30, 1983, abandoned.

[51] Int. Cl.[4] ..... F16K 25/00

[52] U.S. Cl. ..... 251/84; 251/87; 251/301; 4/491

[58] Field of Search ..... 251/84, 87, 301, 333, 251/334, 364, 298, 303, 193, 175, 170, 157; 137/527.14, 527, 527.6, 527.8, 624.13, ; 405/79, 94; 4/491, 488, 496, 497

[56] References Cited

U.S. PATENT DOCUMENTS

| | | | |
|---|---|---|---|
| 1,168,579 | 1/1916 | Thorsby | 137/527.6 |
| 1,409,398 | 3/1922 | Mulvihill | 251/301 |
| 1,763,491 | 6/1930 | Voltz | 4/491 |
| 2,002,043 | 5/1935 | Price | 4/491 |
| 2,027,455 | 1/1936 | Seibt | 137/527.4 |
| 2,818,091 | 12/1957 | Rafferty | 251/303 |
| 3,008,483 | 11/1961 | Beckwith | 251/333 |
| 3,025,677 | 3/1962 | Allston | 137/527.6 |
| 3,060,961 | 10/1962 | Conley | 137/527.4 |
| 3,063,467 | 11/1962 | Roberts, Jr. et al. | 251/333 |
| 3,268,202 | 8/1966 | Murray et al. | 251/303 |
| 3,350,724 | 11/1967 | Leigh | 21/491 |
| 3,502,269 | 3/1970 | Robertson | 137/624.13 |
| 3,864,031 | 2/1975 | Hossfeld et al. | 251/303 |
| 4,118,008 | 10/1978 | Myers | 251/333 |
| 4,142,258 | 3/1979 | Schiron et al. | 4/491 |
| 4,304,255 | 12/1981 | Prince | 251/84 |
| 4,480,812 | 11/1984 | Carpentier | 251/87 |
| 4,539,719 | 9/1985 | Schuster et al. | 4/491 |

FOREIGN PATENT DOCUMENTS

| | | | |
|---|---|---|---|
| 129502 | 3/1932 | Austria | 4/491 |
| 2229261 | 11/1974 | France | 405/94 |

*Primary Examiner*—Samuel Scott
*Assistant Examiner*—H. A. Odar
*Attorney, Agent, or Firm*—Weingarten, Schurgin, Gagnebin & Hayes

[57] ABSTRACT

A valve for a surf pool having a frame of generally horizontal and vertical members, a leg pivotally attached to the higher horizontal member, a foot at the end of the leg for opening and closing the valve and an actuator mounted on the lower horizontal member for pivoting the leg. The foot may include oblique surfaces for reducing its drag and for enhancing the seal between the foot and a valve throat in response to hydrostatic pressure on the foot.

16 Claims, 4 Drawing Figures

SURF POOL GATE VALVE

This application is a continuation of Ser. No. 556,303, filed Nov. 30, 1983, now abandoned.

BACKGROUND

The present invention relates to surf pools and particularly to valves used in surf pools for rapidly releasing relatively large quantities of water to create surf.

Pools of water in which waves forming surf may be created are known. Various methods of creating surf have been devised yielding differing results. For example, in U.S Pat. No. 2,056,855 to Herz apparatus for making surf is disclosed. There, a water chamber is disposed at a deep end of a pool and is in communication below the water surface with the water in the pool. Air is alternately and repetitively extracted from, and blown into, the chamber creating waves in the pool as water passes through the opening between the chamber and pool, first in one direction, then in the other. U.S. Pat. No. 3,473,334 to Dexter discloses another apparatus for creating waves and surf in a pool. The patent to Dexter shows a reservoir at the deep end of a pool that may be in communication below the water surface with the water in the pool. A large gate may be rapidly opened or closed to create or cut off, respectively, the communication between the reservoir and the pool. When the gate is closed, water is pumped into the reservoir to a level above that of the water in the pool. Upon the opening of the gate, water flows downward in the reservoir and upward into the pool creating a wave. The gate is then closed and the process repeated.

Other types of equipment are used to make different types of waves in swimming pools. For example, see U.S. Pat. Nos. 3,629,877 to Schuster et al. and 4,276,661 to Baker. These other types of wave making equipment generally do not use valves as Dexter does.

Although the Dexter disclosure permits construction of apparatus producing waves of sufficient height for surfing, the valve he discloses, a gate that is rapidly raised and lowered by hydraulic means, was not successful. Various other constructions of valves that will quickly release large quantities of water to produce a surfing wave have been attempted. In one such construction a gate like Dexter's is fixed to a generally horizontal arm that is pivoted on the end opposite the gate. A hydraulic cylinder is attached to the arm and hung from the ceiling of the reservoir. To open the gate, the arm is lifted by the hydraulic cylinder. The large forces needed to rapidly operate this valve result in damage to the reservoir ceiling. In another similar construction, the hydraulic actuator is connected to the arm and mounted on the floor of the reservoir. While this arrangement does operate the gate satisfactorily, it creates other problems. The hydraulic cylinder is always submerged and therefore subjected to the chlorinated water of the pool. The fluid in the hydraulic cylinder can leak, contaminating the pool water. Any maintenance work to be performed on the hydraulic actuator must be performed underwater or the pool must be drained. Since the typical surf pool contains several million gallons of water, draining and refilling the pool is exceedingly expensive and time consuming. Both of these valve constructions require the lifting of the entire weight of the valve by the cylinder. Therefore only a hydraulic cylinder is sufficiently powerful to open these valves.

SUMMARY OF THE INVENTION

In the present invention a gate valve for surf pools is devised that allows rapid opening for quick discharge of large volumes of water. The inventive valve may be operated by a pneumatic actuator so that contamination of the pool water may be avoided. Moreover, the actuator may be serviced above water without draining the pool. The inventive valve has a coated steel frame that may be set in a chamber in a reservoir or a surf pool. A foot is mounted on legs that pivotally depend from the upper part of the frame. The frame includes a horizontal support for an actuator to pivot the legs and foot to open the valve. The moving valve parts may be lightweight and the foot is streamlined to reduce the resistance to its movement through the water. As a result, the actuator may be pneumatic, avoiding the possibility of hydraulic oil contamination of pool water. The actuator is placed on the frame at a level above the quiescent level of the pool water, permitting servicing of the actuator without draining the pool. The valve may also include a throat assembly for setting directly on the chamber floor. The foot engages that throat assembly and compresses a gasket to establish a liquid-tight seal. The foot and throat are shaped so that the pressure of water above the foot enhances the quality of the seal between the foot and throat assembly.

DETAILED DESCRIPTION OF PREFERRED EMBODIMENT

Figure 1:
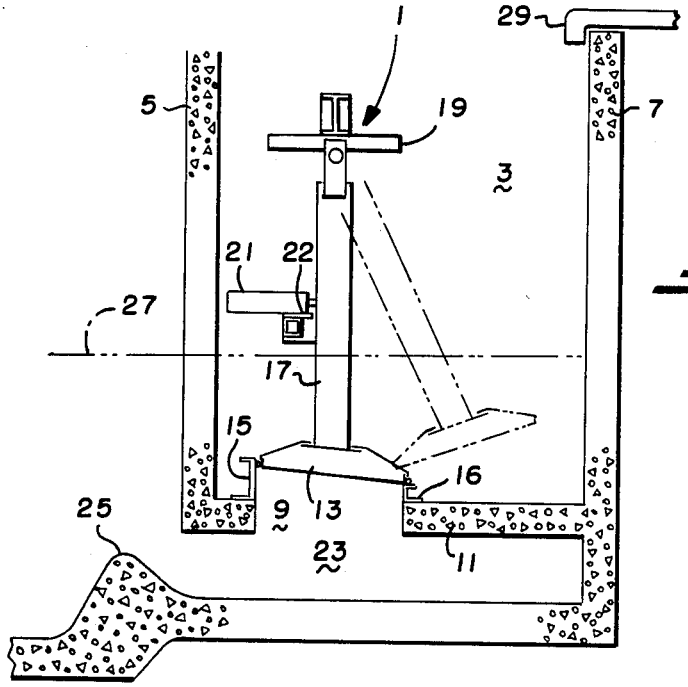
FIG. 1 is a schematic sectional side view of an embodiment of the invention installed in a surf pool.

In all the figures, like elements are given the same reference numerals. In FIG. 1 an embodiment of a gate valve 1 according to the invention is schematically shown in side view. The valve is placed within a chamber 3 having a front wall 5 facing the surf pool and an opposing rear wall 7. Chamber 3, which is made of concrete or like material, has side walls that have been removed from the figure for clarity. The side supports that form part of valve 1 are also not shown in FIG. 1. Chamber 3 has an opening 9 in its bottom wall 11 which is closed by the foot 13 of valve 1. In the closed position of the valve, foot 13 rests on a throat having front and rear elements 15 and 16, respectively. The throat also has side elements not shown in FIG. 1 and fits around and over the periphery of opening 9. Foot 13 is attached to a leg 17 of valve 1 that is pivotally attached to a support 19. An actuator 21 mounted on a shelf 22, supported by the side supports not shown in the figure, can push on leg 17 to pivot foot 13 off the throat to open the valve, as indicated in phantom lines, and establish communication between chamber 3 and a chamber 23 lying below chamber 3. Chamber 23 leads to a surf pool and includes a deflector 25 at its outlet to create surf in the manner disclosed in the patent to Dexter. The quiescent water level 27 in the pool is indicated in the drawing as if valve 1 were open. A pipe 29 is connected to the outlet of a pump that pumps into chamber 3 water drawn from the pool. When valve 1 is closed, the water level in the chamber 3 rises, creating a hydraulic head. When valve 1 opens, the head pushes a large volume of water rapidly through the conduit between chambers 3 and 23 and across deflector 25 generating a surf wave. When the head is created, actuator 21 may be submerged; but as shown in FIG. 1, actuator 21 is above the quiescent water level of the surf pool.

Figure 2:
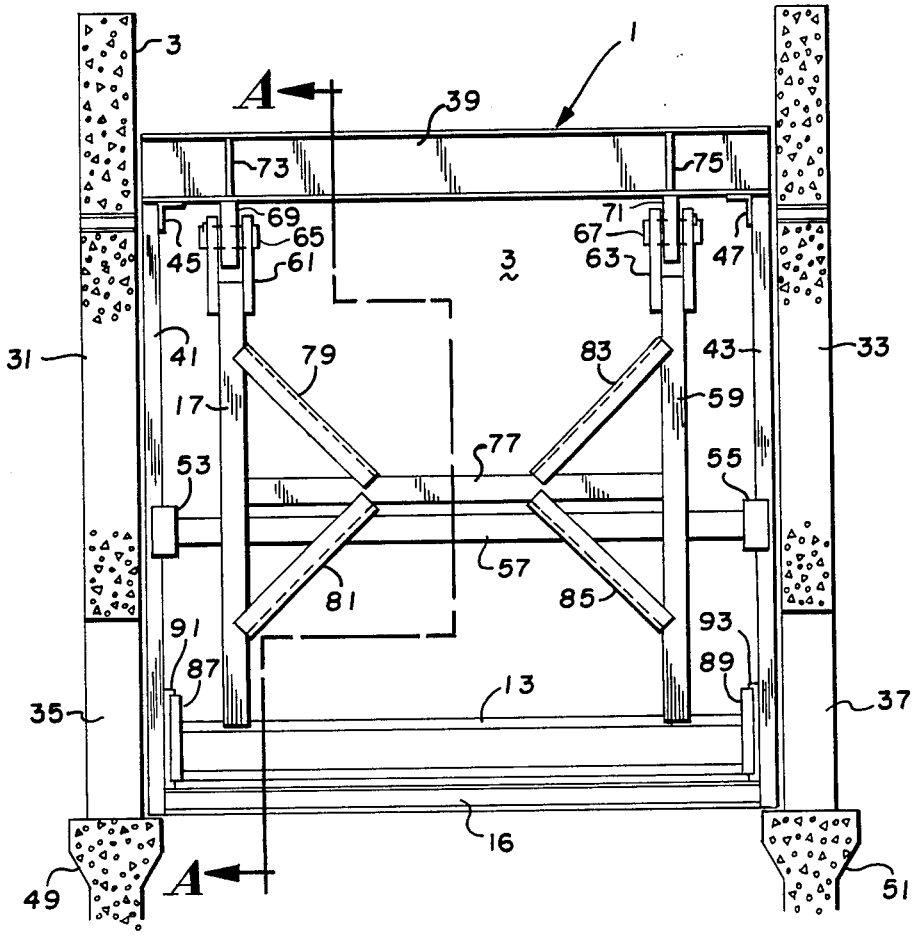
FIG. 2 is a rear view of an embodiment of a gate valve according to the invention.

FIG. 2 is a rear view, that is a view toward the surf pool, of an embodiment of a valve according to the invention. Chamber 3 in which the valve is located has opposing side walls 31 and 33 which contain passageways 35 and 37, respectively, for communication between like chambers on either side of chamber 3. An upper horizontal member 39, which may be an I-beam, is supported at either side of the chamber, along walls 31 and 33 by vertical supports 41 and 43. These supports are connected to beam 39 by conventional means through angle brackets 45 and 47, respectively. Supports 41 and 43 are fastened to walls 31 and 33 by conventional means and rest on piers 49 and 51, respectively. Brackets 53 and 55 are fastened to vertical supports 41 and 43, respectively, to support a second horizontal frame member 57 that lies to the front, i.e., on the same side as the surf pool, of leg 17.

The valve embodiment illustrated includes a leg 17 and a symmetrically located leg 59. Each leg terminates at its upper end in a clevis 61 and 63, respectively. Pins 65 and 67, pivotally connect clevises 61 and 63 to flanges 69 and 71, respectively, that depend from member 39. If member 39 is an I-beam, it is preferred to weld webs 73 and 75 between the flanges of the beam directly above flanges 69 and 71 to add strength to the beam. Like webs are welded into the beam on the side not visible in FIG. 2. Additional reinforcing is provided by a generally horizontal strut 77 spanning and joined to legs 17 and 59. Diagonal struts 79, 81, 83 and 85, which may be made of angle brackets, are welded between strut 77 and the valve legs to give the assembly additional strength for moving through a large volume of water.

The lower ends of legs 17 and 59 are joined to foot 13 which is moved to open and close the valve. The rear member 16 of the valve throat is also visible in FIG. 2. As is further explained with respect to FIG. 4, the ends of foot 13 include fins 87 and 89, respectively, to aid sealing of the valve against the side members, 91 and 93 of the valve throat.

Figure 3:
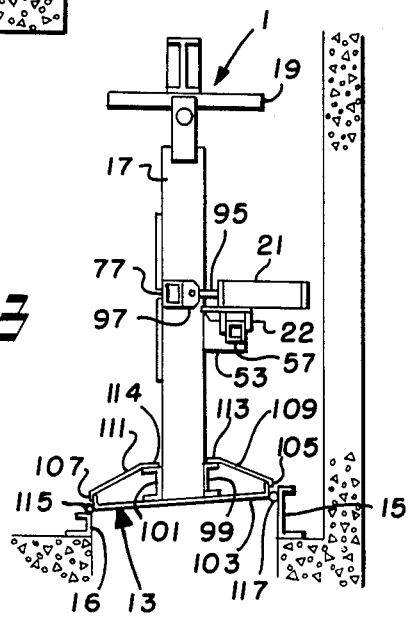
FIG. 3 is a side view, taken along section line AA, of an embodiment of a surf valve according to the invention.

A sectional side view of the valve embodiment of FIG. 2 taken along section line AA appears in FIG. 3 to aid understanding of the embodiment. In FIG. 3, bracket 53 can be seen supporting member 57, a tube of rectangular cross section. Shelf 22, formed of L brackets supporting a flat surface shelf, is fastened to member 57 by conventional means. Actuator 21 is pivotally fastened to shelf 22 by conventional means such as pivot pins. A shaft 95 of actuator 21 may be forced outward, to the left in FIG. 3. The end of shaft 95 is pivotally attached to a block 97 that rests against and pushes against strut 77. When actuator 21 is activated, shaft 95 pushes the pivotable assembly of the valve so that foot 13 is pivoted, clockwise in FIG. 3, off the throat assembly opening the valve. Likewise, when shaft 95 retracts, the force of gravity causes foot 13 to return to the valve throat to close the valve.

Foot 13 is shown in sectional view in FIG. 3. As with all other elements of the valve that occupy significant volume, such as the legs, support 57 and strut 77, foot 13 is preferably hollow and sealed against intrusion of water. The hollow construction reduces the mass of the moving parts of the gate valve and, therefore, the energy needed to open the valve. That is, legs 17 and 59 are preferably tubing of rectangular cross section that protrudes into foot 13. Foot 13 is stiffened at the end of each leg by C shaped stiffeners 99 and 101. Foot 13 may be formed from steel shapes, welded together to form the shape shown in FIG. 3. A generally flat sheet with turned edges generally perpendicular to the sheet forms the bottom 103 of the foot. Relatively narrow sections 105 and 107 forming the front and rear of the foot, respectively, are part of oblique sections 109 and 111, respectively.

The oblique sections 109 and 111 terminate in flat sections 113 and 114, respectively, cut to receive the legs. Sections 113 and 114 are supported by and welded to stiffeners 99 and 101 to form the top of foot 13. As indicated in FIG. 3, bottom 103 of foot 13 is not perpendicular to leg 17. Rather, bottom 103 is lower with respect to floor 11 of chamber 3 near rear wall 7 than at the front side of the valve.

In order to provide a throat mating with the tipped foot 13, the front element 15 of the throat is much taller than the rear element 16. By providing a tilted bottom 103 on, and the oblique surfaces 109 and 111 on top of, foot 13, the weight of the water above the foot when the valve is closed produces a net force component that urges the foot against the throat to enhance the sealing of the valve. The oblique surfaces 109 and 111 also reduce the drag on foot 13 as it moves through water in chamber 3 either to open or close the valve. Compressible gaskets aid in sealing the valve. These gaskets may be conventional "tadpole" gaskets formed of a hollow cylinder with a dependent flange for attachment to a surface. A gasket 115 is shown mounted on the top of throat member 16 for compression by the bottom 103 of foot 13 and another gasket 117 is mounted on the rear surface of throat member 15 for compression by the front surface 105 of foot 13.

Figure 4:
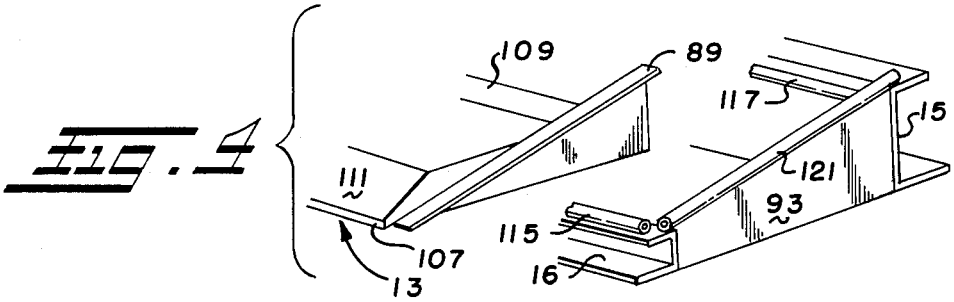
FIG. 4 is a perspective view of a portion of a throat assembly in a valve according to an embodiment of the invention.

An additional gasket arrangement, best seen in FIG. 4 provides seals at the ends of foot 13. There, an end portion of the throat and an end portion of foot 13 are shown separated to illustrate the end seal. End 93 of the throat is shown. An opposite end 91 completes the perimeter of the throat. Throat end 93 tapers from a narrow width at its rear edge, which is flush with element 16, to a wider width at its front edge, which is flush with front throat element 15. Along its tapered edge, end 93 carries a gasket 121. Fin 89 projects from the end of foot 13 at such an angle that as the valve closes, fin 89 engages and compresses gasket 121. Because of the manner in which foot 13 pivots away from the throat, fin 89 does not tear or abrade gasket 121 so that the fin and gasket provide a reliable seal when the valve is closed. Although other seals could be constructed, the fin arrangement is preferred because it adds little drag to the movement of the foot through water.

As clearly illustrated in FIGS. 3 and 4 the gaskets 115 and 117 are generally parallel to each other and to the pivot axis 65 of the legs 17 and 59. Gaskets 115 and 117 thus define a first plane which is inclined with respect to the axis of legs 17 and 59 when the foot 13 is seated. The foot also carries fins 87 and 89 (see FIGS. 2 and 4) which seal against tapered end elements 91 and 93. Gasket 121 (FIG. 4) and its mate (not shown) on the opposite side of the throat are disposed between the fins 89 and 87 and the end elements 93 and 91 (respectively), the gaskets being mounted to the respective end elements. As illustrated in FIG. 4, the plane defined by gasket 121 and its mate is disposed at an angle with respect to the first plane defined by gaskets 115 and 117.

Installation of the valve embodiment is relatively simple. The concrete chamber is poured to accept the valve. Then the throat assembly is attached to the floor of the chamber around the periphery of the conduit leading out of the bottom of the chamber. The remainder of the valve assembly can then be lowered into the chamber and positioned so that the valve operates as desired. Then the valve is anchored to the piers and chamber walls.

It is preferred that the elements of the valve be made of steel since many preform shapes are readily available and the special shapes in the valve may be welded from plates of steel. In order to protect the steel from the chlorinated pool water, all exposed surfaces are coated with commercially available epoxy passivating paint. Unlike many known valves, the entire weight of the valve need not be lifted in order to open the valve. Instead, the valve needs only to be pushed on its pivot to be opened. In addition, the lightweight and streamlined design of the gate valve permits it to be opened and closed with a pneumatic rather than a hydraulic cylinder, eliminating any danger of contamination of the pool water with hydraulic oil. By choosing the location of shelf 22 to be above the quiescent water level in the chamber, all moving parts of the valve can be serviced, above water, without draining the pool.

An example of a valve according to the invention has been constructed. The example included a conduit 9 approximately 9 feet wide by 3 and one half feet across. The valve assembly was approximately 10 feet high. The valve could be opened or closed by a pneumatic actuator in 1.25 seconds. In a cycle including a 0.5 second dwell time, the valve was capable of discharging over 60,000 gallons of water while maintaining some hydraulic head.

The invention has been described with reference to a preferred embodiment. Various substitutions, modifications and additions without departing from the spirit of the invention will occur to one of skill in the art. Therefore, the scope of the invention is limited solely by the following claims.

I claim:

1. A surf pool gate valve for controlling the flow of water through a water carrying conduit from a water storage chamber of a surf pool which storage chamber when full with water provides a hydraulic head of at least ten feet, said valve comprising:

a frame, a valve seat attached to the periphery of an end of a water carrying conduit, a foot for selectively controlling the flow through the conduit by seating against the valve seat, axially extending leg means fixedly connected to the foot for suspending the foot from the frame for pivoting movement about an axis, a peripheral seal connected to one of the foot and valve seat, said seal including first portions defining a first plane inclined with respect to the axis of the leg means when the foot is seated against the valve seat whereby the hydraulic head tends to compress the seal between the foot and valve seat, the seal having second portions defining a second plane disposed at an angle with respect to the first plane whereby abrasion of the seal upon movement of the foot is reduced, and actuating means for moving the leg means and foot against the hydraulic head between seated and open positions.

2. The surf pool gate valve of claim 1 wherein the first seal portions extend generally parallel to the pivot axis of the leg.

3. The surf pool gate valve of claim 1 wherein the foot has a leading edge as defined by the direction of movement of the foot from the closed position toward the open position and the first and second planes intersect approximately at the leading edge of the foot when the valve is closed.

4. The surf pool gate valve of claim 2 wherein the foot has a leading edge as defined by the direction of movement of the foot from the closed position toward the open position and the first and second planes intersect approximately at the leading edge of the foot when the valve is closed.

5. The surf pool gate valve of claim 3 where in the first and second portions of the seal are formed of generally straight sections of resilient material.

6. The surf pool gate valve of claim 5 wherein the foot includes flanges extending outwardly therefrom and positioned to engage the second seal portions when the valve is in the closed position.

7. The surf pool gate valve of claim 6 wherein the actuating means is disposed above the water level in the storage chamber when the valve is open.

8. The surf pool gate valve of claim 6 wherein the flanges are parallel to the second plane when the valve is closed.

9. The surf pool gate valve of claim 3 wherein the foot has a generally flat bottom surface generally parallel to the first plane when the valve is closed.

10. The surf pool gate valve of claim 1 wherein the actuating means includes a pneumatically driven rod.

11. The surf pool gate valve of claim 1 wherein the valve seat includes generally vertical front and rear members of different heights and tapering members joining the front and rear members.

12. The surf pool gate valve of claim 11 wherein the peripheral seal includes resilient gasket material disposed on the front, rear and side members for engagement by the foot when the valve is in the closed position.

13. The surf pool gate valve of claim 11 wherein the second portions of the seal are connected with the tapering members of the valve seat.

14. The surf pool gate valve of claim 11 wherein the first portions of the seal are connected with the front and rear members of the valve seat.

15. The surf pool gate valve of claim 11 wherein the foot has leading and trailing edges as defined by the direction of movement of the foot from the closed position toward the open position, the tapering members of the valve seat being narrowest at the leading edge and increasing in height toward the trailing edge, a first one of the first portions of the seal being disposed to engage the trailing edge of the foot when the valve is closed.

16. The surf pool gate valve of claim 15 wherein the first one of the first portions of the seal is disposed below the highest part of the tapering member.

* * * * *